United States Patent [19]

Kroon et al.

[11] Patent Number: 4,932,061

[45] Date of Patent: Jun. 5, 1990

[54] MULTI-PULSE EXCITATION LINEAR-PREDICTIVE SPEECH CODER

[75] Inventors: Peter Kroon, Murray Hill, N.J.; Edmond F. A. Deprettere, The Hague; Robert J. Sluyter, Eindhoven, both of Netherlands

[73] Assignee: U.S. Philips Corporation, New York, N.Y.

[21] Appl. No.: 841,906

[22] Filed: Mar. 20, 1986

[30] Foreign Application Priority Data

Mar. 22, 1985 [NL] Netherlands ..... 8500843

[51] Int. Cl.[5] ..... G10L 3/02; G10L 7/02; G10L 9/18

[52] U.S. Cl. ..... 381/30; 381/31; 381/35; 381/40

[58] Field of Search ..... 381/29-40, 381/41-53; 364/513.5

[56] References Cited

U.S. PATENT DOCUMENTS

| | | | |
|---|---|---|---|
| 4,038,495 | 7/1977 | White | 381/40 |
| 4,472,832 | 9/1984 | Atal et al. | 381/40 |
| 4,689,120 | 5/1987 | Ono | 381/40 |
| 4,716,592 | 12/1987 | Ozawa et al. | 381/40 |
| 4,720,865 | 1/1988 | Taguchi | 381/49 |
| 4,724,535 | 2/1988 | Ono | 381/31 |

OTHER PUBLICATIONS

Atal et al., "A New Model of LPC Excitation for Producing Natural-Sounding Speech at Low Bit Rates", ICASSP 82, May 3-5, 1982, Paris.

Berouti et al., "Efficient Computation and Encoding of the Multipulse Excitation for LPC", ICASSP 84, Mar. 19-21, 1984, San Diego, CA.

Sluyter, et al., "A 9.6 Kbit/S Speech Coder for Mobile Radio Applications", IEEE International Conf. on Comms., ICC'84, May 14-17, 1984, Netherlands.

Kailath et al., "Displacement Ranks of Matrices and Linear Equations", Journal of Mathmatical Analysis and Applications, pp. 395-407, 1979.

Kroon et al., "Experimental Evaluation of Different Approaches to the Multi-Pulse Coder", ICASS '84, Mar. 19-21, 1984, San Diego, CA.

Kroon et al., "In the Design of LPC-Vocoders with Multi-Pulse Excitation", Proc. of the Sixth European Conf. on Ckt. Theory & Design, Sep. 6-8, 1983, BCCTD83, Stuttgart, Germany.

Lev-et al, "Lattice Filter Parametrization and modeling of Nonstationary Processes, " IEEE Trans. on Information the Dry, vol. IT-30, No. 1, Jan. 1984, pp. 2-16.

L. R. Rabiner et al., *Digital Processing of Speech Signals*, (Prentice Hall 1978), pp. 396-421.

J. D. Market et al., "Implementation and Comparison of Two Transformed Reflection Coefficient Scalar Quantization Methods", IEEE Trans. Acoustics, Speech, SIG. Proc., vol. ASSP-28, No. 5, (Oct. 1980), pp. 575-583.

M. D. Paez et al., "Minimum Mean-Squared-Error Quantization in Speech PCM & DPCM Systems", IEEE Trans. Commun., vol. COM-20, No. 2, pp. 225-230.

*Primary Examiner*—Gary V. Harkcom

*Assistant Examiner*—David D. Knepper

*Attorney, Agent, or Firm*—Anne E. Barschall; Jack E. Haken

[57] ABSTRACT

A multi-pulse excitation linear-predictive speech coder operates in accordance with an analysis-by-synthesis method for determining the excitation. The coder (10) comprises an LPC-analyzer (11), a multi-phase excitation generator (13), means (12, 14) for forming an error signal representative of the difference between an original speech signal (s(n)) and a synthetic speech signal (s(n)), a filter (15) for perceptually weighting the error signal and means (16) responsive to the weighted error signal (e(n)) for generating pulse parameters controlling the excitation generator (13) so as to minimize a predetermined measure of the weighted error signal. The LPC-parameters and the pulse parameters of the excitation signal (x(n)) are encoded for efficient storage or transmission. The bit capacity required for pulse position encoding of the excitation signal (x(n)) is considerably reduced by arranging the excitation generator (16) for an excitation signal (x(n)) which in each excitation interval (L) consists of a pulse pattern having a grid of a predetermined number (q) of equidstant pulses and by arranging the control means (16) for generating pulse parameters characterizing the grid position (k) relative to the beginning of the excitation interval (L) and the variable amplitudes ($b_k(j)$, $1 \leqq j \leqq q$) of the pulses of the grid.

7 Claims, 6 Drawing Sheets a

| m | R(m)/R(0) |
|---|---|
| 0 | 1.000000 |
| 1 | 0.706954 |
| 2 | 0.288408 |
| 3 | 0.058929 |
| 4 | 0.000000 |
| 5 | 0.007231 |
| 6 | 0.012605 |
| 7 | 0.006186 |
| 8 | 0.000000 |
| 9 | -0.000926 |
| 10 | 0.000309 |
| 11 | 0.000631 |
| 12 | 0.000000 |
| 13 | -0.000403 |
| 14 | -0.000273 |
| 15 | -0.000050 |
| 16 | 0.000000 |

b

MULTI-PULSE EXCITATION LINEAR-PREDICTIVE SPEECH CODER

(A) Background of the Invention.

The invention relates to a multi-pulse excitation linear-predictive coder for processing digital speech signals partitioned into segments, comprising:

a linear prediction analyzer responsive to the speech signal of each segment for generating prediction parameters characterizing the short-time spectrum of the speech signal, an excitation generator for generating a multi-pulse excitation signal partitioned into intervals, each excitation interval containing a sequence of at least one and at most a predetermined number of pulses, means for forming an error signal representative of the difference between the speech signal and a synthetic speech signal constructed on the basis of the multi-pulse excitation signal and the prediction parameters, means for perceptually weighting the error signal, and means responsive to the weighted error signal for generating in each excitation interval pulse parameters controlling the excitation generator to minimize, in a time interval at least equal to the excitation interval, a predetermined function of the weighted error signal.

Such a speech coder which functions in accordance with an analysis-by-synthesis method for determining the excitation is known from the article by B. S. Atal et al. on multi-pulse excitation in Proc. IEEE ICASSP 1982, Paris, France, pages 614–617 and the U.S. Pat. No. 4,472,832.

The basic block diagram of this type of coder is shown in FIG. 4 of the article by B. S. Atal et al. For each speech signal segment of, for example, 30 ms the LPC-parameters are calculated which characterize the segment-time spectrum of the speech signal, the LPC-order usually having a value between 8 and 16 and the LPC-parameters in that case representing the segment-time spectral envelope. These calculations are repeated with a period of, for example, 20 ms. An excitation generator produces a multi-pulse excitation signal which in each excitation interval of, for example, 10 ms contains a sequence of pulses of usually not more than 8 to 10 pulses. In response to the multi-pulse excitation signal an LPC-synthesis filter, whose coefficients are adjusted in accordance with the LPC-parameters, constructs a synthetic speech signal which is compared with the original speech signal for forming an error signal. This error signal is perceptually weighted with the aid of a filter which gives the format regions of the speech spectrum less emphasis than the other regions (de-emphasis). Thereafter the weighted error signal is squared and averaged over a time interval at least equal to the 10 ms excitation interval in order to obtain a meaningful criterion for the perceptual difference between the original and the synthetic speech signals. The pulse parameters of the multi-pulse excitation signal, that is to say the positions and the amplitudes of the pulses in the excitation interval, are now determined such that the mean-square value of the weighted error signal is minimized. The LPC-parameters and the pulse parameters of the excitation signal are encoded and multipled to form a code signal having a bit rate in the 10 kbit/s region suitable for efficient storage or transmission in systems having a limited bit capacity. As regards the construction of the synthetic speech signal, the difference with the traditional LPC-synthesis is based on the fact that the overall excitation for the LPC-synthesis filter is produced by a generator generating in each 10 ms excitation interval a sequence of pulses having at least 1 and not more than 8 to 10 pulses.

Several variants of the above-described basic block diagram are known. In accordance with a first variant, an error signal is produced, not by constructing a synthetic speech signal and comparing it with the original speech signal, but by comparing the multi-pulse excitation signal itself with a prediction residual signal derived from the original speech signal with the aid of an LPC-analysis filter which is the inverse of the LPC-synthesis filter; in addition the perceptual weighting filter is modified correspondingly (see FIG. 4 of the article by P. Kroon et al. in Proc. European Conf. on Circuit Theory and Design, 1983, Stuttgart, FRG, pages 390–394). The error signal thus obtained is very closely related to the error signal in the basic block diagram and consequently is representative of the difference between the original and the synthetic speech signals. This first variant provides the advantage that the coder has a simpler structure than the coder in accordance with the basic block diagram. In accordance with a second variant, the quality of the synthetic speech signal is improved by not only calculating LPC-parameters characterizing the envelope of the segment-time spectrum of the speech signal, but also LPC-parameters characterizing the fine structure of this spectrum (pitch prediction) and by utilizing both types of LPC-parameters for constructing the synthetic speech signal (see FIG. 2 of the article by P. Kroon et al. in Proc. IEEE ICASSP 1984, San Diego Calif., U.S.A., pages 10.4.1–10.4.4). With the necessary changes having been made, this second variant can also be used in a speech coder in accordance with the first variant.

When judging multi-pulse excitation coders (MPE-coders) three criteria play an important role:

the complexity of the coder, the required bit capacity of the code signal, the perceptual quality of the synthetic speech signal.

The complexity of MPE-coders is predominantly determined by the error minimizing procedure used for selecting the best possible position and amplitudes of the sequence of pulses in the excitation intervals. The excitation pulse sequence is subject to serve constraints with a view to the encoding of the pulse parameters and the LPC-parameters to form a code signal having a bit rate in the 10 kbit/s region and, in their turn, these constraints affect the quality of the synthetic speech signal. Thus, it appears that digital speech signals having a sampling rate of 8 kHz can be encoded in their totality with 9.6 kbit/s and that a good speech quality can be preserved during synthesis when, for example, only 8 excitation pulses are allowed in each 10 ms interval (80 samples).

The optimum procedure for error minimization then consists in determining the best possible amplitudes for all the possible combinations of the positions of the 8 excitation pulses in the 10 ms interval (80 samples) and in selecting that excitation pulse sequence which results in the lowest value of the error criterion. The number of possible combinations of the pulse positions is however so high —

$$\binom{80}{8} \approx 3 \times 10^{10}$$

— that this optimum procedure becomes extremely complex and a realistic implementation is actually impossible. In all MPE-coders known so far use is therefore made of a sub-optimum procedure for error minimization, the position and the amplitude of the pulses of the excitation pulse sequence then being determined sequentially, that is to say always for one pulse at a time. This sub-optimum procedure can be refined by recalculating all pulse amplitudes simultaneously once the pulse positions have been found, or better still, each time the position of a subsequent pulse has been determined. Further improvements in this sub-optimum procedure resulting in a lower complexity are described in, for example, the above-mentioned articles by P. Kroon et al.

Yet, for all these MPE-coders it continues to hold that the necessary encoding of the positions of the excitation pulses in an excitation interval requires an important portion of the available overall bit capacity of about 10 kbit/s. Even when an efficient pulse position encoding method is used, as described in the article by N. Berouti et al. in Proc. IEEE ICASSP 1984, San Diego, Calif., U.S.A., pages 10.1.1–10.1.4, the encoding of the positions of 8 pulses in a 10 ms excitation interval (80 samples) requires $$\left\lceil \log_2 \binom{80}{8} \right\rceil = 35$$

bits every 10 ms, so an overall bit capacity of 3.5 kbit/s for pulse position encoding alone.

(B) Summary of the Invention.

The invention has for its object to provide a speech coder of the type defined in the preamble of paragraph (A), which compared with known MPE-coders requires a considerably lower bit capacity for encoding the pulse positions of the excitation signal.

The speech coder according to the invention is characterized in that:

- the excitation generator is arranged for generating an excitation signal which in each excitation interval consists of a pulse pattern having a grid of a predetermined number of equidistant pulses, and
- the means for controlling the excitation generator are arranged for generating pulse parameters characterizing the position of the grid relative to the beginning of an excitation interval and the variable amplitudes of the pulses of the grid.

The saving in bit capacity for the pulse position encoding of the excitation signal obtained by the measures according to the invention renders it possible to allow a larger number of excitation pulses per unit of time and consequently to construct a synthetic speech signal with a perceptual quality which compares favorably with those of prior art MPE-coders having a code signal of the same bit rate.

In addition, the temporal regularity of the excitation pulse pattern offers the feature that the amplitudes of the excitation pulses can be determined optimally in accordance with an error minimization procedure which can be expressed in terms of matrix calculation, which has as its advantage that the sets of equations can be solved particularly efficiently on account of the specific structure of their matrices. In addition, this low degree of computational complexity can be still further reduced without detracting from the perceptual quality of the synthetic speech signal at code signals having a bit rate in the region around 10 kbit/s. One possibility for that purpose is to impose a Toeplitzstructure on the matrices, an alternative possibility for that purpose is to truncate the impulse response of the perceptual weighting filter such that the matrices become diagonal matrices. An alternative for the last-mentioned possibility is the choice of a fixed perceptual weighting filter which is related to the long time average of speech and in designing this filter such that the auto-correlation function of its impulse response is zero at equidistant instants which have the same distance as the equidistant pulses of the excitation pulse pattern.

(C) Short description of the drawings.

Particulars and advantages of the speech coder according to the invention will now be explained in greater detail in the following description of exemplary embodiments with reference to the accompanying drawings, in which.

Figure 1:
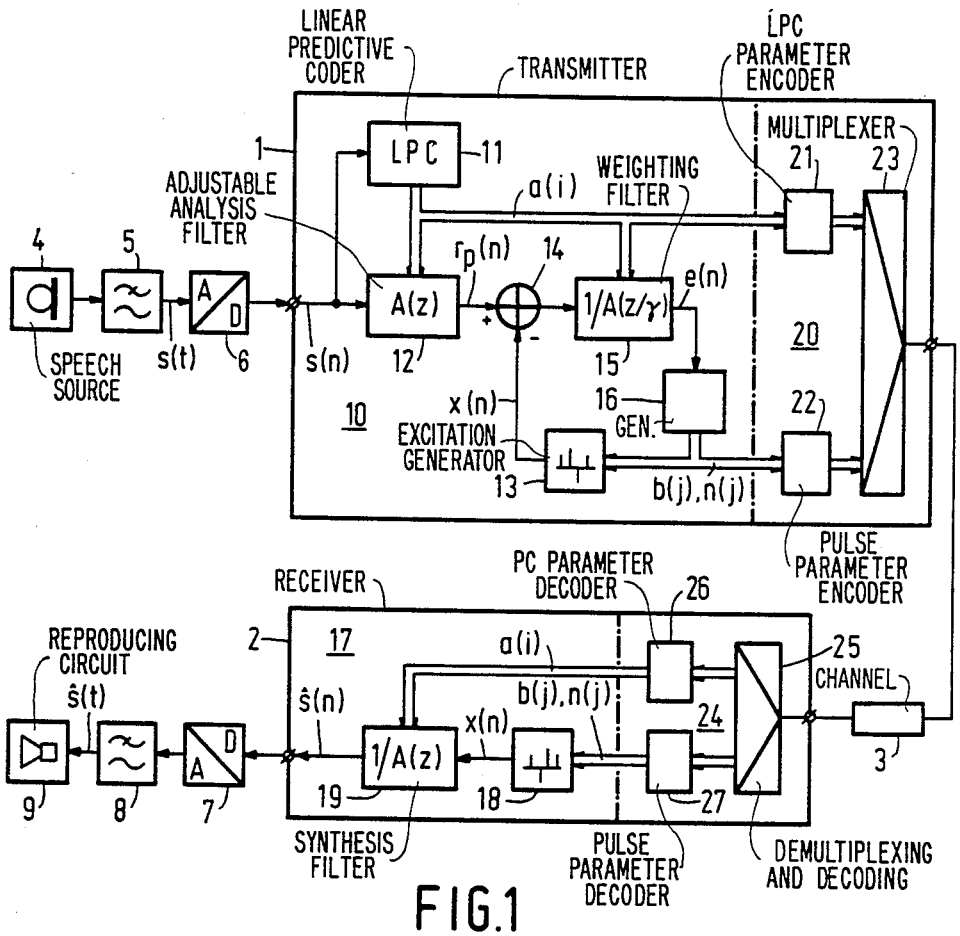
FIG. 1 shows a block diagram of a system for transmitting digital speech signals utilizing an MPE-encoder and a corresponding MPE-decoder, in which the invention can be used.
Figure 4:
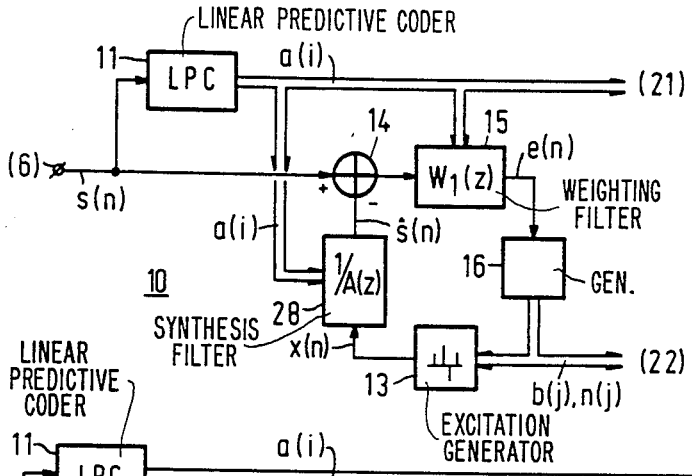
Figure 5A:
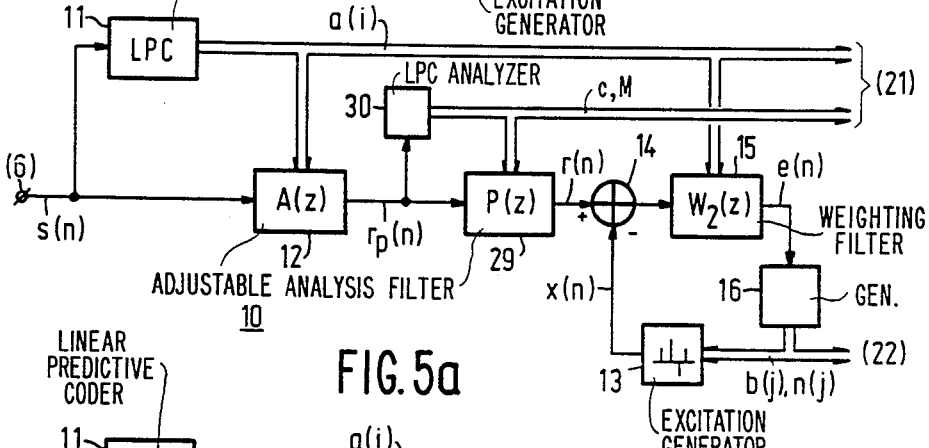
Figure 5B:
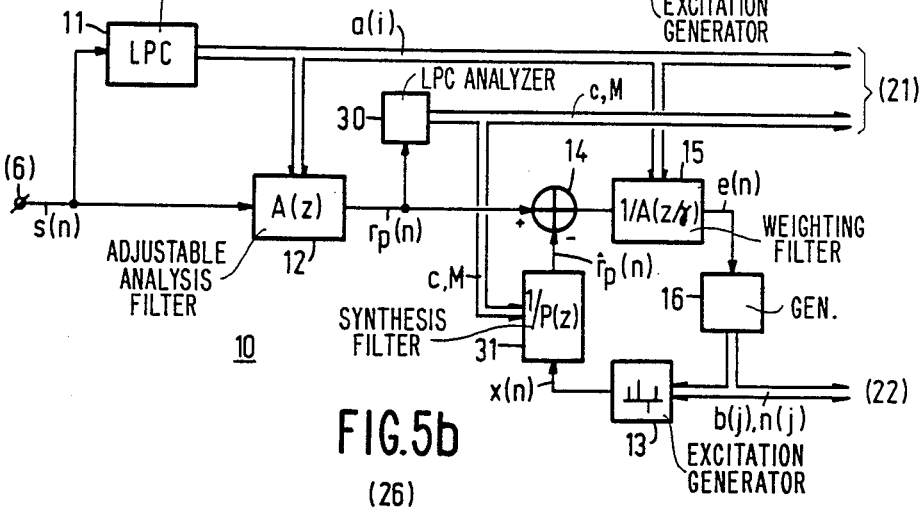
Figure 5C:
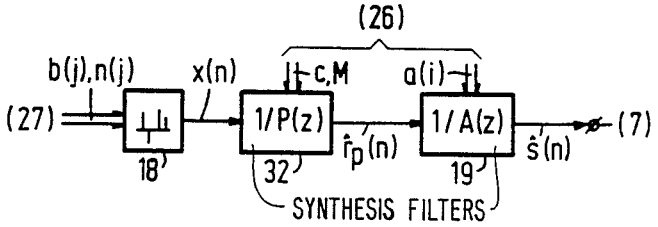

FIG. 3*a–f* shows a number of time diagrams to illustrate the operation of an MPE-encoder according to the invention;

FIG. 4 shows a block diagram of an MPE-encoder having a structure different from the structure of FIG. 1 in which the invention can also be used;

FIG. 5*a–c* shows a number of block diagrams of an MPE-encoder and a corresponding MPE-decoder having a structure as shown in FIG. 1 in which use is also made of LPC-parameters characterizing the fine structure of the short-time speech spectrum (pitch-prediction) and in which the invention can also be used;

FIG. 6*a–d*, FIG. 7*a–d* and FIG. 8*a* and *b* show a number of time and frequency diagrams and a Table for illustrating feasible modifications of the perceptual weighting filter in an MPE-coder of FIG. 1 which result in a reduction of the computational complexity of an MPE-encoder according to the invention.

(D) Description of the embodiments.

D(1) General description.

FIG. 1 shows a functional block diagram for the use of an MPE-encoder in accordance with the first variant of paragraph (A) in a system comprising a transmitter 1 and a receiver 2 for transmitting a digital speech signal through a channel 3, whose transmission capacity is significantly lower than the value of 64 kbit/s of a standard PCM-channel for telephony.

This digital speech signal represents an analog speech signal originating from a source 4 having a microphone or a different electro-acoustic transducer, and being limited to a speech band of 0.4 kHz by means of a low-pass filter 5. This analog speech signal is sampled at an 8 kHz sampling frequency and converted into a digital code suitable for use in transmitter 1 by means of an analog-to-digital converter 6 which at the same time effects partitioning of this digital speech signal in overlapping segments of 30 ms (240 samples) which are refreshed every 20 ms. In transmitter 1 this digital speech signal is processed into a code signal having a bit rate in the region around 10 kbit/s which is transmitted via channel 3 to receiver 2 and is processed therein into a digital synthetic speech signal which is a replica of the original digital speech signal. By means of a digital-to-analog converter 7 this digital synthetic speech signal is converted into an analog speech signal which, after having been limited in frequency by a low-pass filter 8, is applied to a reproducing circuit 9 having a loudspeaker or a different electro-acoustic transducer.

Transmitter 1 includes a multipulse excitation coder (MPE-coder) 10 which utilizes linear-predictive coding (LPC) as a method of spectral analysis. As MPE-coder 10 processes a digital speech signal representative of the samples s(nT) of an analog speech signal s(t) at instants t=nT, where n is an integer and 1/T=8 kHz, this digital speech signal is designated by the customary notation of the form s(n). A notation of this form is also used for all the other signals in the MPE-coder 10.

In MPE-coder 10 the segments of the digital speech signal s(n) are applied to an LPC-analyzer 11, in which the LPC-parameters of a 30 ms speech segment are calculated in known manner every 20 ms, for example on the basis of the autocorrelation method or the covariance method of linear prediction (see L. R. Rabiner, R. W. Schafer, "Digital Processing of Speech Signals", Prentice-Hall, Englewood Cliffs, 1978, Chapter 8, pages 396–421). The digital speech signal s(n) is also applied to an adjustable analysis filter 12 having a transfer function A(z) which in z-transform notation is defined by:

$$A(z) = 1 - \sum_{i=1}^{p} a(i)\, z^{-i} \tag{1}$$

where the coefficients a(i) with $1 \leqq i \leqq p$ are the LPC-parameters calculated in LPC-analyzer 11, the LPC-order p usually having a value between 8 and 16. The LPC-parameters a(i) are determined such that at the output of filter 12 a (prediction) residual signal $r_p(n)$ occurs having a segment-time (30 ms) spectral envelope which is as flat as possible. Filter 12 is therefore known as an inverse filter.

MPE-coder 10 operates in accordance with an analysis-by-synthesis method for determining the excitation. To that end, MPE-coder 10 comprises an excitation generator 13 producing a multi-pulse excitation signal x(n) partitioned into time intervals of, for example, 10 ms (80 samples). In each 10 ms excitation interval (80 samples), this excitation signal x(n) contains a sequence of j pulses with $1 \leqq j \leqq J$ and, for example, J=8, each pulse having an amplitude b(j) and a position n(j) within this interval (so $1 \leqq n \leqq 80$). In a difference producer 14, this excitation signal x(n) is compared with the residual signal $r_p(n)$ at the output of inverse filter 12. The difference $r_p(n) - x(n)$ is perceptually weighted with the aid of a weighting filter 15 for obtaining a weighted error signal e(n). This weighting filter 15 is chosen such that the formant regions in the spectrum of the weighted error signal e(n) get less emphasis (de-emphasis). Weighting filter 15 has a transfer function W(z) in z-transform notation and an appropriate choice for W(z) is given by:

$$W(z) = 1/A(z/\gamma) \tag{2}$$

where $$A(z/\gamma) = 1 - \sum_{i=1}^{p} a(i)\, \gamma^{i} z^{-i} \tag{3}$$

a(i) being the LPC-parameters calculated in LPC-analyzer 11 and $\gamma$ being a constant factor between 0 and 1 determining the bandwidth of the formants and in practice having a value between 0.7 and 0.9.

The weighted error signal e(n) is applied to a generator 16 which in each 10 ms excitation interval determines the pulse parameters b(j) and n(j) of the excitation signal x(n) for controlling excitation generator 13. In generator 16, the weighted error signal e(n) is squared and accumulated over a time interval of at least 10 ms so as to obtain a meaningful error measure E of the perceptual difference between the original speech signal s(n) and a synthetic speech signal ŝ(n) constructed in response to the excitation signal x(n) and the LPC-parameters a(i). In generator 16, the pulse parameters b(j) and n(j) are now determined such that the error measure E is minimized. For error measure E it holds that:

$$E = \sum_{n} e^2(n) \tag{4}$$

the limits of the sum not yet having been specified because they depend on the method (autocorrelation or covariance) used for the error minimization.

The most elementary form of transmission of the LPC-parameter a(i) and the pulse parameters b(j), n(j) is a direct transmission from transmitter 1 to receiver 2. Receiver 2 includes an MPE-decoder 17 having an excitation generator 18 controlled by the transmitted pulse parameters b(j), n(j) for generating the multi-pulse excitation signal x(n), and an adjustable synthesis filter 19 controlled by the transmitted LPC-parameters a(i) for constructing a synthetic speech signal ŝ(n) in response to the excitation signal x(n). The transfer function of synthesis filter 19 is:

$$1/A(z) \tag{5}$$

A(z) being the transfer function of inverse analysis filter 12 in transmitter 1 as defined in formula (1).

In practice, the digital transmission of the LPC-parameters a(i) and the pulse parameters b(j), n(j) require quantizing and encoding. To that end, transmitter 1 comprises an encoding-and-multiplexing circuit 20 including an LPC-parameter encoder 21, a pulse parameter encoder 22 and a multiplexer 23, and receiver 2 comprises a corresponding demultiplexing-and-decoding circuit 24 including a demultiplexer 25, and LPC-parameter decoder 26 and a pulse parameter decoder 27.

As is known, the use of "inverse sine" variables or theta coefficients $\theta(i)$ obtained by first converting LPC-parameters a(i) into reflection coefficients k(i) and then to employ the transform:

$$\theta(i) = \sin^{-1}[k(i)]\, 1 \leqq i \leqq p \tag{6}$$

is to be preferred for the transmission of the LPC parameters a(i). These theta coefficients $\theta(i)$ are quantized and encoded every 20 ms, the assignment of the total number of bits to the different coefficients $\theta(i)$ and the quantizing characteristic being determined in accordance with a known method of minimizing the expected value of the spectral deviation due to quantization (cf. J. D. Markel et al., IEEE Trans. Acoust., Speech,, Signal Processing, Vol. ASSP-28, No. 5, Oct. 1980, pages 575–583). For example, when in parameter encoder 21 there are 44 bits available every 20 ms for transmitting 12 LPC-parameters a(i) and the LPC-order consequently is p=12, then the following bit assignment for the theta coefficients $\theta(1)$–$\theta(12)$ is used: 7 bits for $\theta(1)$; 5 bits for $\theta(2)$, $\theta(3)$; 4 bits for $\theta(4)$–$\theta(6)$; 3 bits for $\theta(7)$–$\theta(9)$; 2 bits for $\theta(10)$–$\theta(12)$. The bit capacity required for the theta coefficients then amounts to 2.2 kbit/s. Since synthesis filter 19 in receiver 2 utilizes LPC-parameters a(i) obtained from quantized theta coefficients $\theta(i)$ with the aid of parameter decoder 26, inverse analysis filter 12 in transmitter 1 must utilize the same quantized values of the LPC-parameters a(i).

For the transmission of each of the two types of pulse parameters b(j) and n(j) of the excitation signal x(n) several encoding methods are possible. Good results can be obtained by using for the amplitudes b(j) a simple adaptive PCM method, the maximum absolute value B of the amplitudes b(j) being determined in each 10 ms excitation interval and these amplitudes b(j) being uniformly quantized in a range (−B, +B), Using an encoding with 3 bits per amplitude b(j) and a logarithmic encoding with 6 bits for maximum value B in a dynamic range of 64 dB, the bit capacity then required for encoding 8 amplitudes b(j) per 10 ms excitation inteval is 3.0 kbit/s. For encoding the pulse positions n(j) use can be made of the combinatorial encoding method mentioned in paragraph (A), a number of $$\left\lceil \log_2 \binom{80}{8} \right\rceil = 35$$

bits per 10 ms being required for encoding 8 positions n(j) per excitation interval of 10 ms (80 samples) and the bit capacity required for pulse position encoding then being 3.5 kbit/s. However, this encoding method is arithmetically complex and therefore a differential position encoding is preferred, in which the position n(j) is encoded relative to the preceding position n(j−1) and the first position n(1) relative to the beginning of the excitation intervals. In practice, it was found that intervals between consecutive positions n(j−1) and n(j) with a value of 4 ms (32 samples) or more occur only with a very low probability so that encoding each differential position with 5 bits is sufficient. The bit capacity required for this differential encoding of the pulse positions n(j) then amounts to 4.0 kbit/s.

In multiplexing the code signals for the theta coefficients (2.2 kbit/s) and for the pulse parameters b(j) and n(j) of the excitation signal (3.0+4.0=7.0 kbit/s), 2 bits are added by multiplexer 23 to the 20 ms frame for synchronizing demultiplexer 25 so that a total bit capacity of 9.3 kbit/s is required in the described example.

This example clearly shows that an important part (43%) of the overall bit capacity of 9.3 kbit/s is used for encoding the pulse positions of the excitation signal.

In accordance with the invention, a significant saving in the bit capacity for pulse position encoding is now achieved by arranging excitation generator 13 of MPE-coder 10 in transmitter 1 for generating an excitation signal x(n) which in each excitation interval of L samples (L×125 μs) consists of a pulse pattern having a grid of a predetermined number of q equidistant pulses, two consecutive pulses being spaced apart by D samples and the following relation existing between the integers L, q and D:

$$L=qD \tag{7}$$

Within each excitation interval this grid of q pulses can assume D possible positions and the position of this grid is characterized by the position k of the first pulse in this grid, it holding that $$1 \leqq k \leqq D = L/q \tag{8}$$

For the position n(j) of the pulses in this grid it then holds that $$n(j)=k+(j-1)D1 \leqq j \leqq q \tag{9}$$

and the pulse in position n(j) has an amplitude $b_k(j)$. In addition, generator 16 is arranged for determining grid position k and amplitude $b_k(j)$ as pulse parameters for controlling excitation generator 13 and in generator 16 these pulse parameters are again determined such that the error measure E defined by formula (4) is minimized.

For a specific MPE-coder 10 the numbers L and D are chosen optimally, but otherwise these numbers are fixed magnitudes. When the same excitation interval as in the described example is chosen (so 10 ms, L=80) and the maximum number of pulses per excitation interval of this example is chosen for the fixed number of pulses of the grid (so q=J=8), then it appears that this grid can assume 10 different positions within the excitation interval (since D=L/q=10) and that the position of this grid can be encoded with only 4 bits (since $1 \leqq k \leqq 10 < 2^4$). For pulse position encoding of the excitation signal x(n) a bit capacity of only 0.4 kbit/s is then required instead of the above-mentioned value of 4 kbit/s. With a substantially equal overall bit capacity the saving of 4.0–0.4=3.6 kbit/s obtained by these measures, can now be utilized to increase the number of excitation pulses per unit of time by using, for example 2000 pulses per second instead of 800 pulses per second as in the embodiment already described. This implies that in a 10 ms (L=80) excitation interval 20 excitation pulses now occur instead of 8, it being possible for the grid to assume 4 different positions (D=L/q=80/20=4) and the position of the grid can be encoded with only 2 bits. When the amplitudes $b_k(j)$ of these 20 pulses are again encoded with 3 bits per amplitude and the maximum absolute value B of the amplitudes in the excitation interval of 10 ms is again logarithmically encoded with 6 bits, then the amplitude encoding of the excitation signal x(n) requires a bit capacity of 6.6 kbit/s and the pulse position encoding requires only 0.2 bit/s. If the further data of MPE-coder 10 are not altered and a bit capacity of 2.2 kbit/s is used for encoding the 12 theta coefficients and 0.1 kbit/s for frame synchronisation, then the required overall bit capacity amounts in this case to 6.6+0.2+2.2+0.1=9.1 kbit/s.

In response to this excitation signal x(n), in which the restriction in the degree of freedom of the pulse positions is combined with an increase in the number of excitation pulses per second, a synthetic speech signal $\hat{s}(n)$ is obtained at the output of synthesis filter 19 in MPE-decoder 17 whose perceptual quality compares advantageously with the quality in the embodiment already described, in which the degree of freedom of the pulse positions was not restricted.

Although in this excitation signal x(n) the spacing D between two consecutive pulses is constant within each excitation interval (in the last case D=4), this generally does not hold for the spacing between the first pulse of an excitation interval and the last pulse of the preceding excitation interval as the grid positions in these excitation intervals need not be the same. This prevents the excitation signal x(n) from having a long-time regularity of 1 to D in its pulse positions. This is an advantage, it is known from literature that such a long-time regularity of the excitation in the class of RELP coders (Residual-Excited Linear Prediction Coders) may lead to audible "metallic" background noise known as "tonal noise" being produced (cf. the article by R. J. Sluyter in Proc. IEEE Int. Conf. on Commun. 1984, Amsterdam, the Netherlands, pages 1159–1162). In this connection it is advantageous to choose for the length of the excitation interval a value of, for example, 5 ms (L=40) without changing the number of excitation pulses per second. This implies that 10 excitation pulses now occur in a 5 ms excitation interval (L=40), it being possible for the grid to assume 4 different positions (D=L/q=40/10=4) and the position of the grid being encoded with 2 bits. When the maximum absolute value of the amplitudes of the excitation pulses are again determined every 10 ms (so now over 2 excitation intervals) and the further data of MPE-coder 10 are not changed, then the pulse positioning encoding requires a bit capacity of 0.4 kbit/s so that the total required bit capacity is in this case 6.6+0.4+2.2+1.1=9.3 kbit/s and consequently is equal to the bit capacity required in the first-described example.

Figure 2:
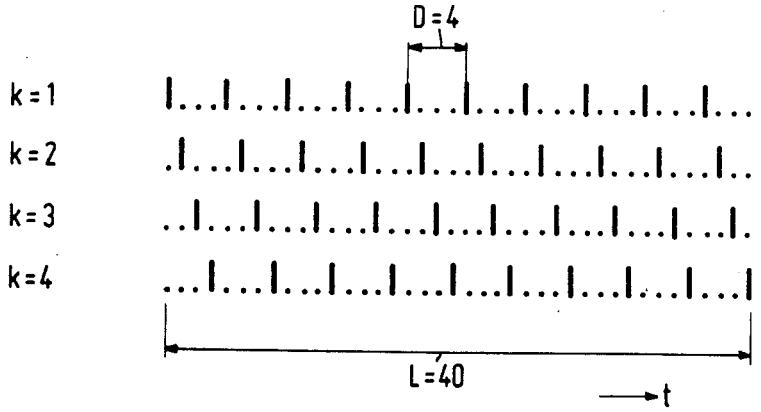
FIG. 2 shows the possible positions of the grid of an example of the excitation signal in an MPE-encoder according to the invention.

For the case in which the excitation signal x(n) is partitioned into 5 ms excitation intervals, in which 10 excitation pulses are produced with a mutual spacing of 0.5 ms, so for the values L=40, q=10 and D=L/q=4, FIG. 2 shows the excitation grids within an arbitrary excitation interval for the 4 possible grid positions k=1, 2, 3 and 4. The allowed pulse positions n(j) as defined in formula (9) are marked in each grid by vertical lines and the remaining pulse positions by dots.

Figure 3:
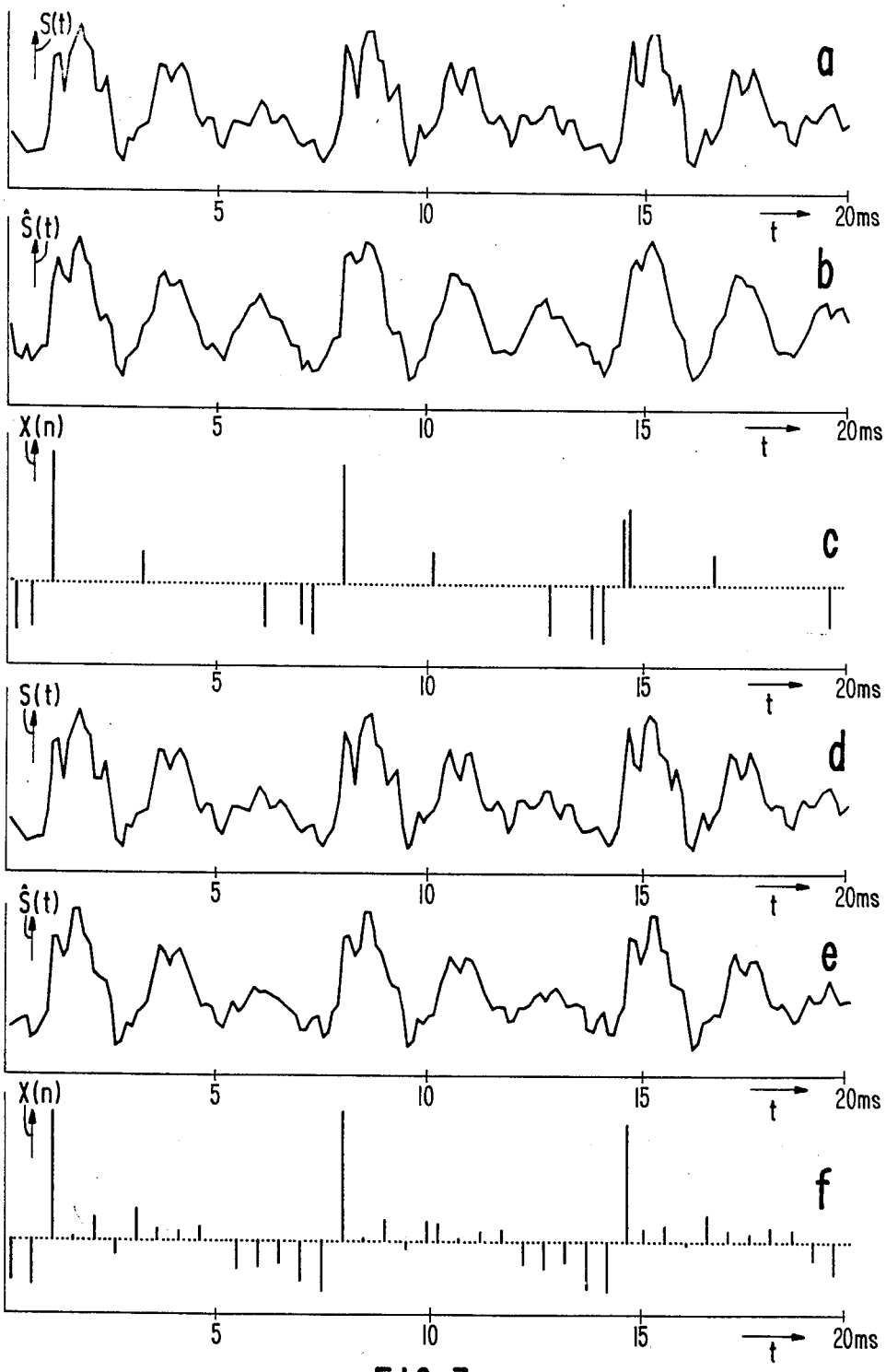

To illustrate the operation of MPE-coder 10 according to the invention, FIG. 3 shows a number of time diagrams, all relating to the same 30 ms speech signal segment (the portion shown has a length of approximately 20 ms). For an MPE coder 10 in accordance with the described prior art having not more than 8 pulses per 10 ms excitation interval, diagram a shows the original speech signal s(t) at the output of filter 5 in transmitter 1, diagram b shows the synthetic speech signal ŝ(t) at the output of filter 8 in receiver 2, and diagram c shows the excitation signal x(n) at the outputs of generator 13 in transmitter 1 and generator 18 in receiver 2. In a similar way, diagram d, e and f show the signals s(t), ŝ(t) and x(n) of the respective diagrams a, b and c for an MPE-coder 10 according to the invention having always 10 pulses in each 5 ms excitation interval (see FIG. 2); diagram d and diagram a in FIG. 3 are identical. Comparing diagrams e and b for signal s(t) with diagram a for signal ŝ(t) gives already a first impression of the experimentally ascertained fact that the perceptual quality of synthetic signal ŝ(t) for an MPE-coder according to the invention compares favourably with that for an MPE-coder in accordance with the described prior art with a code signal of the same bit rate (9.3 kbit/s in this case).

D(2) Variants of the MPE-coder in FIG. 1.

FIG. 4 shows a functional block diagram of an MPE-coder having a structure in accordance with the basic block diagram of paragraph (A), which is also suitable for use in the system of FIG. 1. Elements in FIG. 4 corresponding to those in FIG. 1 are given the same reference numerals.

The important difference with FIG. 1 is that in MPE-coder 10 of FIG. 4 the original speech signal s(n) is directly applied to difference producer 14 and is compared therein with a synthetic speech signal ŝ(n). This synthetic speech signal ŝ(n) is constructed in response to the excitation signal x(n) of generator 13 with the aid of a synthesis filter 28 controlled by the LPC-parameters a(i) of LPC-analyzer 11 and having a transfer function 1/A(z), A(z) again being defined by formula (1). This difference s(n)−ŝ(n) is perceptually weighted by means of a weighting filter 15 which in this case has a transfer function $W_1(z)$ defined by:

$$W_1(z)=A(z)/A(z/\gamma) \tag{10}$$

with A(z/γ) given by formula (3).

The measures according to the invention can be used with the same advantageous results in a MPE-coder 10 of the type shown in FIG. 4 as in an MPE-coder 10 in accordance with FIG. 1. For the case of FIG. 4 the same corresponding MPE-decoder 17 can be used as in FIG. 1.

FIG. 5 shows functional block diagrams of MPE-coders 10 having a structure in accordance with the second variant of paragraph (A) applied to an MPE-coder 10 as shown in FIG. 1, and further a functional block diagram of the corresponding MPE-decoder 17. Elements of FIG. 5 corresponding to those of FIG. 1 are given the same reference numerals.

As has already been stated in paragraph (A), it is known that the quality of the synthetic speech signal is increased by not only calculating LPC-parameters a(i) characterizing the envelope of the segment-time spectrum of the speech signal but also LPC-parameters characterizing the fine structure of this spectrum (pitch-prediction) and by utilizing both types of LPC-parameters for the construction of the synthetic speech signal.

The ideal excitation for the synthesis is the (prediction) residual signal $r_p(n)$ and MPE-coder 10 tries to model this signal $r_p(n)$ to the best possible extent by the multi-pulse excitation signal x(n). This residual signal $r_p(n)$ has a segment-time spectral envelope which is as flat as possible, but may, more specifically in voice speech segments, evidence a periodicity which corresponds to the fundamental tone (pitch). This periodicity manifests also in the excitation signal x(n) which will use the excitation pulses in the first place to model the most important fundamental tone pulses (see also diagrams c and f of FIG. 3), at the cost of an impairment in modeling the remaining details of the residual signal $r_p(n)$.

Block diagram a of FIG. 5 differs from the MPE-coder 10 of FIG. 1 in that any periodicity is removed from the residual signal $r_p(n)$ with the aid of a second adjustable analysis filter 29, as a result of which a modified residual signal r(n) with a pronounced non-periodical character is produced at the output of filter 29. Without any essential loss in efficiency a filter 29 can be used whose transfer function P(z) in z-transform notation is given by $$P(z)=1-cz^{-M} \quad (11)$$

where M is the fundamental interval of the periodicity of residual signal $r_p(n)$, expressed in numbers of samples. These LPC-parameters c and M can in principle be calculated in an extended LPC-analyzer 11 to characterize the most important fine structure of the short-time spectrum of residual signal $r_p(n)$. In block diagram a of FIG. 5 these LPC-parameters c and M are however obtained using a second LPC-analyzer 30 constituted by a simple auto-correlator calculating the auto-correlation function $R_p(n)$ of each 20 ms interval of residual signal $r_p(n)$ for delays n which, expressed in numbers of samples, exceed the LPC-order of LPC-analyzer 11; in addition this auto-correlator 30 determines M as the position of the maximum of $R_p(n)$ for $n>p$ and c as the ratio $R_p(M)/R_p(o)$. Because of the presence of filter 20 weighting filter 15 in block diagram a of FIG. 5 now has a transfer function $W_2(z)$ defined by:

$$W_2(z)=1/[P(z)A(z/\gamma)] \quad (12)$$

where P(z) is defined in formula (11) and $A(z/\gamma)$ is defined in formula (3). In this case there is no need for the excitation signal x(n) to model any periodicity of the residual signal $r_p(n)$, but it is sufficient that it models the modified residual signal r(n) which has a pronounced non-periodical character.

A similar improvement in the speech quality can be achieved by means of an MPE-coder 10 in accordance with block diagram b of FIG. 5 which differs from block diagram a in that filter 29 has been omitted and is replaced by a synthesis filter 31 arranged between excitation generator 13 and difference producer 14, the transfer function of synthesis filter 31 being defined by:

$$1/P(z) \quad (13)$$

where P(z) is defined in formula (11). Also in this case excitation signal x(n) needs only to model the modified residual signal r(n). In response to excitation signal x(n), synthesis filter 31 then constructs a synthetic residual signal $\hat{r}_p(n)$ having the desired periodicity of residual signal $r_p(n)$. Because of the presence of filter 31 weighting filter 15 in block diagram b of FIG. 5 has again the original transfer function W(z) as defined in formula (2).

With the necessary changes having been made, the variant described with reference to block diagrams a and b of FIG. 5 can also be applied to an MPE-coder 10 as shown in FIG. 4. The application of this variant to an MPE-coder according to FIG. 1 as described in FIG. 5 has however the advantage that in that case residual signal $r_p(n)$ is already available.

The corresponding MPE-decoder 17 is shown in block diagram c of FIG. 5 and can be used in all these cases. Block diagram c of FIG. 5 differs from FIG. 1 in that now a second synthesis filter 32 having a transfer function 1/P(z) is arranged between excitation generator 18 and first synthesis filter 19 having a transfer function 1/A(z). This second synthesis filter 32 is controlled by the transmitted LPC-parameters c, M and in response to excitation signal x(n) it constructs a synthetic residual signal $r_p(n)$ which has the desired periodicity and is applied to first synthesis filter 19. Since the value of prediction parameter c is transmitted in the quantized form, filter 29 in block diagram a and filter 31 in block diagram b should utilize the same quantized value of c.

The measures according to the invention can also be utilized in those variants of MPE-coder 10 as described with reference to FIG. 5, the advantages described in the preceding paragraph D(1) then also being obtained. In that case the same corresponding MPE-decoder 17 can be used as shown in block diagram c of FIG. 5.

D(3) Description of the error minimizing procedure.

The procedure for determining grid period k and amplitudes $b_k(j)$ of multi-pulse excitation signal x(n) in an excitation interval of L samples so that error measure E as defined in formula (4) is minimized, can be described, without detracting from its generality, for an excitation interval where $1 \leqq n \leqq L$. For this description the following notations are introduced.

The L samples of the excitation signal x(n) weighted error signal e(n) and residual signal $r_p(n)$ in this excitation interval with $1 \leqq n \leqq L$ are represented by L-dimensional row vectors x, e and $r_p$, where:

$$x=[x(1), x(2), \ldots, x(L)]$$

$$e=[e(1), e(2), \ldots, e(L)]$$

$$r_p=[r_p(1), r_p(2), \ldots, r_p(L)] \quad (14)$$

The q amplitudes $b_k(j)$ of the pulses in an excitation grid with position k are represented by a q-dimensional row vector $b_k$, where:

$$b_k=[b_k(1), b_k(2), \ldots, b_k(q)] \quad (15)$$

When for grid position k a position matrix $M_k$ having q rows and L columns is introduced, it holding for the elements m(j,n) of matrix $M_k$ that:

$$m(j,n)=1 n=k+(j-1)D$$

$$m(j,n)=0 n\neq k+(j-1)D \quad (16)$$

and $D=L/q$, then the excitation vector $x_k$ for grid position k can be written as:

$$x_k=b_kM_k \quad (17)$$

In addition, a matrix H having L rows and L columns is introduced, the j-th row comprising the impulse response of weighting filter 15 produced by a unit impulse $\delta(n-j)$, and the matrix product $M_kH$ is denoted by $H_k$.

Because of the memory hangover of weighting filter 15, a signal $e_{oo}(n)$ occurs in the present interval with $1 \leqq n \leqq L$ which is a residue of the response to the signals x(n) and $r_p(n)$ in previous intervals with $n \leqq o$. The weighted error signal $e_k(n)$ produced in response to excitation signal $x_k(n)$ with grid position k in the present interval $1 \leqq n \leqq L$ then has the following vector representation:

$$e_k=e_o-b_kH_k \quad (18)$$

where $$e_o=e_{oo}+r_pH \quad (19)$$

When the values $n=1$ and $n=L$ are chosen as limits for the sum in formula (4) for error measure E (and consequently the minimization interval is equal to the relevant excitation interval), then the object is to minimize:

$$E_k = e_k e_k^t \tag{20}$$

where the superscript t denotes the transpose of a vector. $E_k$ is a function of both the amplitudes $b_k(j)$ and the grid position k. For a given value of k, the optimum amplitudes $b_k(j)$ can be calculated from formulae (18), (19) and (20) by setting the partial derivatives of $E_k$ to the unknown amplitudes $b_k(j)$ with $1 \leqq j \leqq q$ equal to zero. These amplitudes can then be calculated by solving $b_k$ from the equation:

$$b_k = e_o H_k^t [H_k H_k^t]^{-1} \tag{21}$$

the superscript t denoting the transpose of a matrix and the superscript $-1$ denoting the inverse matrix. By substituting formula (21) in formula (18) and thereafter the resulting expression in formula (20) the following expression for $E_k$ is obtained:

$$E_k = e_o [I - H_k^t [H_k H_k^t]^{-1} H_k] e_o^t \tag{22}$$

where I is the identity matrix.

Basically, the procedure then consists of calculating the error measure $E_k$ for each of the D possible values of k, determining the excitation vector $x_k$ which minimizes error measure $E_k$ for each of the D possible values of k, and selecting that excitation vector $x_k$ which is associated with the smallest minimum error measure $E_k$. Under the constraints given, the selected value $E_k$ is the minimum of $E_k$ as a function of both the amplitudes $b_k(j)$ and the grid position k. Finding grid position k which minimizes $E_k$ is equivalent to finding the value k which in formula (22) maximizes the term $T_k$ given by:

$$T_k = e_o H_k^t [H_k H_k^t]^{-1} H_k e_o^t \tag{23}$$

This basic procedure comprises solving D sets of linear equations of the type defined in formula (21). However, on the basis of their specific structures, the matrices $H_k H_k^t$ to be inverted can be inverted in a particularly efficient manner. These square matrices with dimension q have, namely, a displacement rank equal to (D+2), the displacement rank of a square matrix A being defined as the rank of the matrix:

$$A - ZAZ^* \tag{24}$$

and Z is a shift matrix having elements 1 on the first lower subdiagonal and elements 0 elsewhere and the superscript * denoting the complex conjugate transpose of a matrix (cf. T. Kailath in Journal of Mathematical Analysis and Applications, Vol. 68, No. 2, 1979, pages 395–407). When the number of multiplications is used as a measure for the computational complexity, then it can be demonstrated that inverting a square matrix A having dimensions q and displacement rank (D+2) requires a number of operations of the order $0\{(D+2)(q-1)^2\}$. For solving the D sets of equations using matrices of displacement rank (D+2), use can be made of one of the known procedures (cf. H. Lev-Ari et al. in IEEE Trans. on Inf. Theory, Vol. IT-30, No. 1, Jan. 1984, pages 2–16), it being found that the total complexity for simultaneously solving all the D sets of equations amounts to only approximately twice the complexity for a single system of equations, instead of D times.

In the procedure described so far, the minimization interval is equal to the excitation interval and the limits for the sum in formula (1) for the error measure E are equal to n=1 and n=L. This minimization procedure consequently utilises a covariance method and the matrices $H_k H_k^t$ to be inverted are symmetrical co-variance matrices depending on the value k (k = 1, 2, . . . , D) for the grid position of the excitation signal.

However, for the minimization procedure use can also be made of an auto-correlation method. The limits for the sum in formula (4) for error measure E are then chosen on the basis of the following considerations. Weighting filter 15 with a transfer function W(z) defined by formulae (2) and (3) has a pulse response h(n) which rapidly decays for values $\gamma$ less than 1 and consequently has a finite effective length N, so that in a proper approximation it may be assumed that $h(n)=0$ for $n \geqq N$. As the procedure is utilized for determining grid position k and amplitudes $b_k(j)$ of excitation signal x(n) in an excitation interval $1 \leqq n \leqq L$, this interval is used as a window in the definition of the auto-correlation function and it is consequently assumed that excitation signal x(n) and residual signal $r_p(n)$ are identically zero outside this interval. Weighted error signal e(n) then only differs from zero in the interval $1 \leqq n \leqq L+N-1$, so that as limits for the sum in formula (4) for error measure E the values n=1 and n=L+N−1 can be chosen.

Now a matrix H is introduced having L rows and L+N columns instead of L columns, the j-th row again comprising the impulse response h(n) of weighting filter 15 produced by a unit impulse $\delta(n-j)$. When the matrix product $M_k H$ for this matrix H is again denoted by $H_k$, then the matrix product $H_k H_k^t$ is now a symmetrical auto-correlation matrix having a Toeplitz-structure, the matrix elements being constituted by the auto-correlation co-efficients of impulse response h(n) of weighting filter 15. The minimization procedure can then be effected in the manner described in the foregoing, the matrices $H_k H_k^t$ to be inverted no longer depending on grid position k of excitation signal x(n) and consequently only one matrix inversion needs to be effected. In addition, the choice of the window in this auto-correlation method results in the residual signal $e_{oo}(n)$ being identically zero, so that the vector $e_o$ in formulae (18) and (21)–(23) is now obtained by setting the residual vector $e_{oo}$ identical to zero in formula (19).

From the above considerations it can be seen that the minimization procedures in MPE-coders according to the invention differ from the procedures in prior art MPE-coders by their low computational complexity. This low complexity can be still further reduced without detracting from the perceptual quality of the synthetic speech signal for code signals having a bit rate in the region around 10 kbit/s. Thus, determining grid position k (k=1, 2, . . . , D) for an excitation interval can be simplified by using simple search procedures instead of solving the D sets of linear equations, for example by using the position of the sample of residual signal $r_p(n)$ with the largest amplitude as a reference for positioning the excitation grid or by using the technique as described in the first-mentioned article by P. Kroon et al. in section (A) for the determination of the position of the first excitation pulse and by using this position as a reference for positioning the excitation grid. The elaboration of these search procedures are here however not described, as much more important simplifications can be acquired by an appropriate choice of perceptual weighting filter 15.

D(4) Modifications of the Perceptual Weighting Filter.

Weighting filter 15 in FIG. 1 has a transfer function W(z) as defined in formulae (2) and (3) and an impulse response h(n) which can be simply reduced to the expression:

$$h(n)=h_1(n)\gamma^n \tag{25}$$

$h_1(n)$ being the impulse response of filter 15 for the value $\gamma=1$. Consequently, this impulse response $h_1(n)$ is multiplied by an exponential window function $w_e(n)$ for which it holds that:

$$w_e(n)=\gamma^n \tag{26}$$

Figure 6:
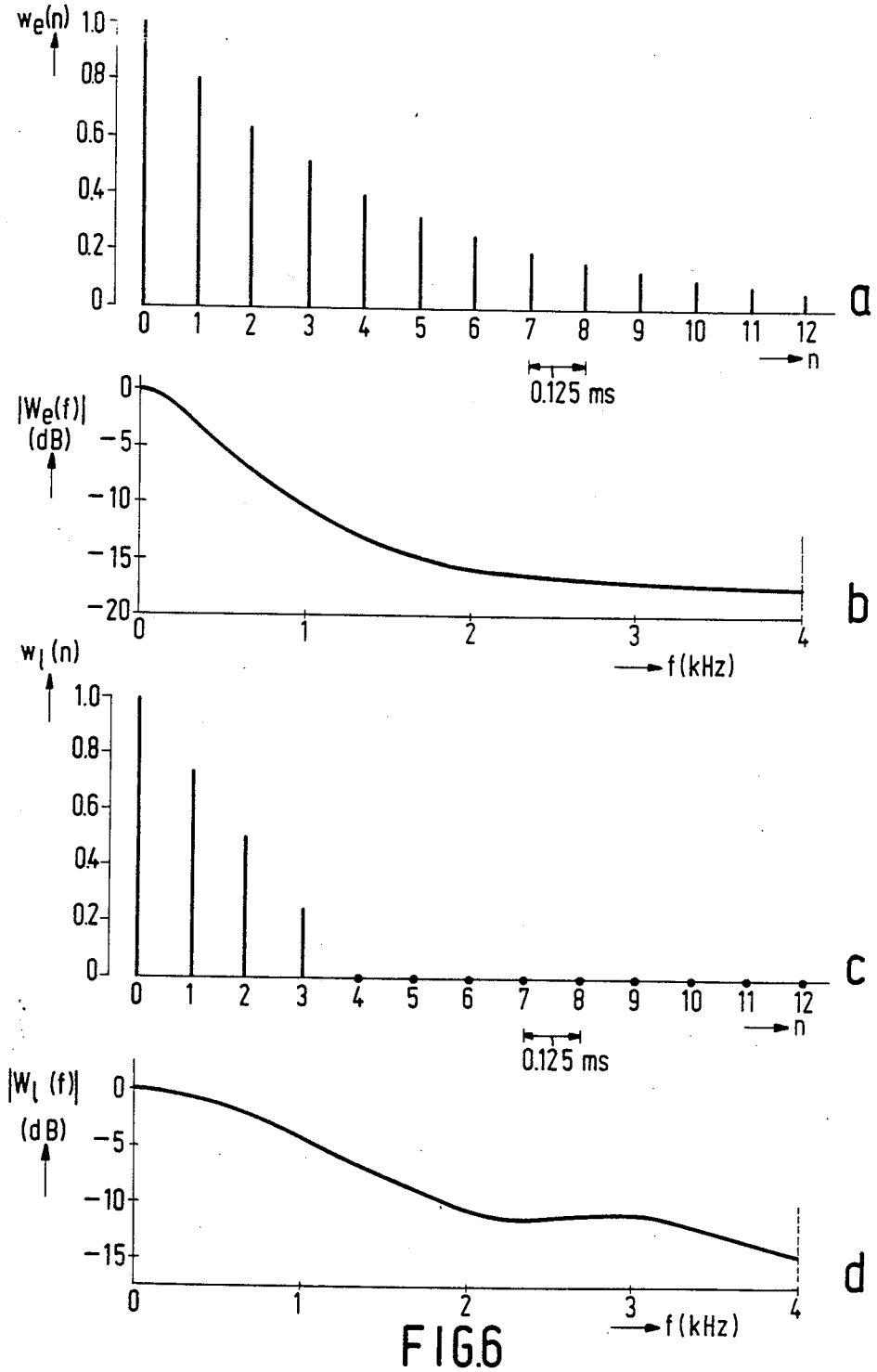

The variation of $w_e(n)$ is shown in time diagram a of FIG. 6 for the value $\gamma=0.8$ and the variation of the corresponding frequency response $W_e(f)$ is shown in frequency diagram b of FIG. 6 for the sampling rate $1/T=8$ kHz.

Now it is possible to choose a different window function $w_1(n)$ with a much shorter effective duration than $w_e(n)$ as defined in formula (26), but with a frequency response $W_1(f)$ of a similar shape as $W_e(f)$. A suitable choice is, for example:

$$w_1(n)=1-n/D_1 0\leqq n\leqq D_1-1$$

$$w_1(n)=0 n\leqq D_1 \tag{27}$$

The variation of $w_1(n)$ is shown in time diagram c of FIG. 6 for the value $D_1=4$ and the variation of the corresponding frequency response $w_1(f)$ in frequency diagram d of FIG. 6, also for the sampling rate $1/T=8$ kHz. When diagrams b and d are compared, it appears that the frequency responses $W_e(f)$ and $W_1(f)$ agree to a very high extent and experiments show that also the subjective perception of the noise-shaping effected by these window functions is substantially the same.

When a linear window function $w_1(n)$ is used, impulse response h(n) of weighting filter 15 is given by:

$$h(n)=h_1(n)w_1(n) \tag{28}$$

It then follows from formula (27) for $w_1(n)$ that:

$$h(n)=0 n\geqq D_1 \tag{29}$$

and consequently that impulse response $h_1(n)$ is truncated at the value $n=D_1-1$.

If now the truncation value $D_1$ is chosen such that:

$$D_1\geqq D=L/q \tag{30}$$

where D is the distance between two equidistant pulses of excitation signal x(n), then this choice results in a significant simplication of the minimization procedures described in paragraph D(3), both in the case of the covariance method and in the case of the auto-correlation method. Namely in both cases the matrix product $H_kH_k^t$ becomes a diagonal matrix (as can be checked in a simple way by writing out the matrices) and in the case of the auto-correlation method this diagonal matrix is even a scalar matrix, all diagonal elements of which have the same values R(o) obtained by determining the auto-correlation function R(m) of impulse response h(n) of weighting filter 15:

$$R(m)=\sum_{i=o}^{D_1-1-m} h(i)h(i+m) \tag{31}$$

for the value m=0. This value R(o) may be different for different excitation intervals, but is a constant for each excitation interval. In the case of the auto-correlation method, inverting matrix product $H_kH_k^t$ amounts to calculating only once in each excitation interval the scalar quantity 1/R(o). On the basis of formula (23) the grid position of excitation signal x(n) can then be found as the value k which maximizes the expression:

$$e_oH_k^tH_ke_o^t \tag{32}$$

and the amplitudes $b_k(j)$ of excitation signal x(n) can then be calculated by solving for the value k this found, vector $b_k$ from the equation $$b_k=[1/R(o)]e_oH_k^t \tag{33}$$

which is derived from formula (21) and contains the scalar quantity 1/R(o).

In formula (32), (33) vector $e_o$ is given by:

$$e_o=r_pH \tag{34}$$

since in the auto-correlation method the residual vector $e_{oo}$ in formula (19) is identically zero.

Figure 7:
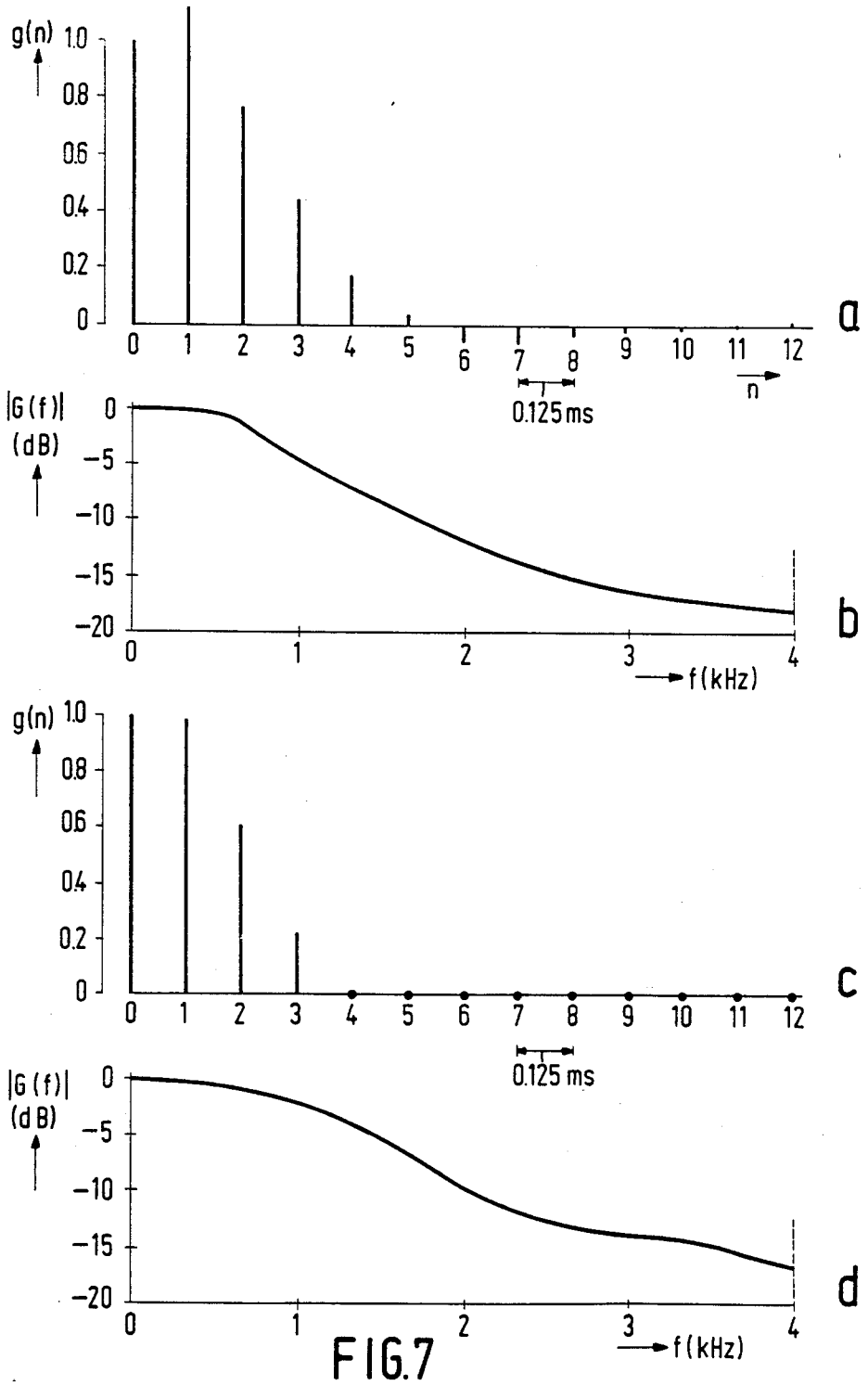

A second possibility to simplify the minimization procedures described in section D(3) is the use of a fixed weighting filter 15 which is related to the long-time average of the speech. Experiments have shown that the subjective perception of a noise-shaping effected by such a fixed weighting filter 15 is qualified as being at least as good as the noise shaping effected by an adjustable weighting filter 15 described in the foregoing, when for the transfer function W(z) of this fixed weighting filter 15 the following function G(z) is chosen:

$$G(z)=1/\left[1-\sum_{i=1}^{2} a(i)\,\gamma^i z^{-i}\right] \tag{35}$$

with the values:

$$\gamma=0{,}8$$
$$a(1)=1{,}3435$$
$$a(2)=-0{,}5888$$

the coefficients a(1) and a(2) being related to the long-time average of speech and being known from the literature (cf. M.D. Paez et al. in IEEE Trans. on Commun., Vol. COM-20, No. 2, Apr. 1972, pages 225–230). The impulse response g(n) of this fixed weighting filter 15 can again be written as:

$$g(n)=g_1(n)\gamma^n \tag{36}$$

where $g_1(n)$ is the impulse response of filter 15 for the value $\gamma=1$ and impulse response $g_1(n)$ is consequently multiplied by an exponential window function $w_e(n)$ defined by formula (26). Time diagram a of FIG. 7 shows the variation of g(n) for the value $\gamma=0.8$ and frequency diagram b shows the variation of the corresponding frequency response G(f) for the sampling rate $1/T=8$ kHz.

The use of a fixed weighting filter 15 having a fixed impulse response g(n) results in a significant reduction of the computational complexity of the minimization procedures described in paragraph D(3), both for the covariance method case and for the auto-correlation method case. In both cases, matrix H becomes a fixed matrix and the D matrices $H_k$ and the D matrices $H_k^t$ also become fixed matrices; the same applies to the D matrices $H_kH_k^t$ and their inverse matrices for the covariance method and for the single matrix $H_kH_k^t$ and its inverse matrix for the auto-correlation method. All these fixed matrices can be precalculated and stored in a form suitable for use during the minimization procedures.

If now the impulse response $g_1(n)$ of this fixed weighting filter 15 is not multiplied by an exponential window function $w_e(n)$ but by the linear window function $w_1(n)$ as given in formula (27), the impulse response $g_1(n)$ is truncated at the value $n=D_1$. The impulse response g(n) of weighting filter 15 is then given by:

$$g(n)=g_1(n)w_1(n) \tag{37}$$

and the variation of g(n) is shown for this case in time diagram c of FIG. 7 for the value $D_1=4$ and the variation of the corresponding frequency response G(f) for the sampling rate $1/T=8$ kHz in frequency diagram d. If now the truncation value $D_1$ is again chosen according to formula (30), then this choice results in a combination of the advantages already described in this section, since the fixed matrices $H_kH_k^t$ have moreover become diagonal matrices.

It is however not always necessary to truncate the impulse response of a fixed weighting filter 15 with the object of obtaining a diagonal matrix $H_kH_k^t$. As has already been mentioned in section D(3), the matrix product $H_kH_k^t$ does not depend on the grid position k of excitation signal x(n) when the auto-correlation method is used in the minimization procedure. It has also been stated that the elements of the matrix $H_kH_k^t$ are constituted by the auto-correlation coefficients of impulse response h(n) of weighting filter 15. For a finite effective length N of impulse response h(n) it may be assumed that $h(n)=0$ for $n \geqq N$ and in that case the auto-correlation coefficients of impulse response h(n) are defined by the expression:

$$R(m) = \sum_{i=0}^{N-1-m} h(i)h(i+m) \tag{38}$$

which differs from formula (31) in that generally N is much greater than $D_1$. For a spacing D between two equidistant pulses of excitation signal x(n) the elements on the main diagonal of matrix $H_kH_k^t$ are formed by R(o), the elements on the two first subdiagonals by R(D), the elements on the two second sub-diagonals by R(2D) etc.

It is now possible to choose impulse response h(n) such that $R(m)=0$ for the values:

$$m=D,\ 2D,\ 3D, \ldots \tag{39}$$

(matrix $H_kH_k^t$ consequently becoming a diagonal matrix) and simultaneously such that the corresponding frequency response W(f) of fixed weighting filter 15 exhibits a similar variation as the frequency response G(f) for fixed weighting filter 15 having a transfer function G(z) as defined in formula (35).

Figure 8:
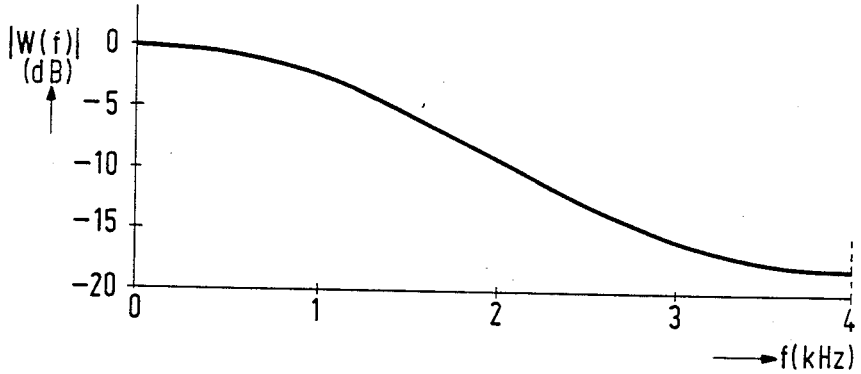

If now R(m) is written as:

$$R(m) = \frac{\sin(\pi m/D)}{\pi m/D} \cdot b(m) \tag{40}$$

then $R(m)=0$ for the values of m in formula (39). From the Fourier transform theory it then follows that for frequency response W(f) the relation holds:

$$|W(f)|^2=F(f)*B(f) \tag{41}$$

the symbol * denoting the convolution operation and F(f) being given by:

$$F(f)=1\ |f| \leqq 1/(2DT)$$

$$F(f)=0\ |f| > 1/(2DT) \tag{42}$$

where $1/T=8$ kHz is the sampling rate. An appropriate choice for B(f) is a Butterworth characteristic of order n:

$$B(f) = \frac{1}{\sqrt{1+(f/f_c)^{2n}}} \tag{43}$$

the order n and the cut-off frequency $f_c$ being determined such that frequency responses W(f) and G(f) have substantially the same attenuation at half the sampling rate $1/(2T)=4$ kHz.; this attenuation is approximately 18 dB. For a value $D=4$ the values $n=3$ and $f_c=800$ Hz are found for the Butterworth characteristic of formula (43). In FIG. 8, diagram a shows the variation of the frequency response W(f) thus obtained which is indeed quite similar to frequency response G(f) in diagram b of FIG. 7. Table b in FIG. 8 shows the normalized values R(m)/R(o) of the auto-correlation co-efficients of impulse response h(n) of this fixed weighting filter 15 having a frequency response W(f) as shown in diagram a in FIG. 8. From this Table it can be seen that for the value $D=4$ it indeed holds that $R(m)=0$ for $m=4, 8, 12, 16$; the values of R(m) for $m>16$ are not included in this Table because these values may be disregarded in practice.

D(5) General Remarks.

The modification of weighting filter 15 as described in section D(4), can alternatively be effected in MPE-coders 10 having a structure as described with reference to FIG. 5, in which use is also made of the LPC-parameters characterizing the fine structure of the short-time speech spectrum (pitch prediction). This holds for block diagram b in FIG. 5, in which weighting filter 15 has the same transfer function and consequently also the same impulse response as in FIG. 1, but also for block diagram a in FIG. 5, in which weighting filter 15 has a transfer function $W_2(z)$ according to formula (12) and consequently also performs the part of a fundamental tone (pitch) synthesis filter with a much longer impulse response than in FIG. 1. By truncating the impulse response after a period of time which is much shorter than the shortest fundamental tone (pitch) periods, the truncated impulse response then becomes equal again to the truncated impulse response for the case shown in FIG. 1 and block diagram b in FIG. 5. Although this causes an additional noise-shaping of fundamental tone (pitch) components in the construction of the synthetic speech signal, the subjective reception of the noise-shaping for the case illustrated by block diagram a in FIG. 5 was found to be substantially the same as for the case illustrated by block diagram b in FIG. 5 and FIG. 1.

Between the MPE-coders in which the modifications of the perceptual weighting filter have not been applied and the MPE-coders in which these modifications have indeed been applied, small differences can be observed in the quality of the synthetic speech signals when the LPC-parameters and the pulse parameters of the excitation signal are represented with a high degree of accuracy. This accurate representation is, however, accompanied by a high bit rate of the code signal. With bit rates of the code signal in the region around 10 kbit/s, the parameters are however quantized such that the quantization effects are greater than the small quality differences. Consequently these small differences have no practical significance.

For the rest, it should be noticed that the aforesaid small differences relate to a synthetic speech signal quality of a level which is considered to be hardly different from toll quality. This quality level is achieved for code signals having a bit rate of about 10 kbit/s.

What is claimed is:

1. A multi-pulse excitation linear-predictive coder for processing digital speech signals partitioned into segments, comprising:

a linear prediction analyzer responsive to the speech signal of each segment for generating prediction parameters characterizing the short-time spectrum of the speech signal, an excitation generator for generating a multi-pulse excitation signal partitioned into intervals, each excitation interval containing a sequence of at least one and at most a predetermined number of pulses, means for forming an error signal representative of the difference between the speech signal and a synthetic speech signal constructed on the basis of the multi-pulse excitation signal and the prediction parameters, means for perceptually weighting the error signal, means responsive to the weighted error signal for generating in each excitation interval pulse parameters controlling the excitation generator to minimize, in a time interval at least equal to the excitation interval, a predetermined function of the weighted error signal wherein the excitation generator is arranged for generating an excitation signal which in each excitation interval has a pulse pattern having a spacing which defines a one-dimensional grid of a predetermined number of equidistant pulses, and means for controlling the excitation generator to generate pulse parameters characterizing the position of the grid relative to the beginning of the excitation intervals and characterizing variable amplitudes of the pulses of the pulse pattern.

2. A multi-pulse excitation linear-predictive coder as claimed in claim 1, characterized in that the means for perceptually weighting the error signal are constituted by a fixed weighting filter having a recursive structure and having filter co-efficients related to the long-time average of speech signals.

3. A multi-pulse excitation linear-predictive coder for processing digital speech signals partitioned into segments, comprising:

a. a linear prediction analyzer, responsive to the speech signal of each segment, for generating prediction parameters characterizing the short-time spectrum of the speech signal;

b. an excitation generator for generating a multi-pulse excitation signal partitioned into excitation intervals, each excitation interval containing a pulse pattern having a spacing which defines a one-dimensional grid, the pulse pattern having a predetermined number of pulses having respective amplitudes, which pulses are equally spaced along an axis which is demarcated in time-related units;

c. means for forming an error signal representative of the difference between the speech signal and a synthetic speech signal constructed on the basis of the multi-pulse excitation signal and the prediction parameters;

d. means for perceptually weighting the error signal to produce a weighted error signal; and e. means responsive to the weighted error signal for generating in each excitation interval pulse parameters controlling the excitation generator to minimize, in a time interval at least equal to the excitation interval, a predetermined function of the weighted error signal, said pulse parameters determining i. a position of the grid relative to a beginning of a current excitation interval; and ii. the respective amplitudes of the pulses of the pulse pattern.

4. The multi-pulse excitation linear-predictive coder of claim 3, wherein the means for perceptually weighting the error signal comprises a fixed weighting filter having a recursive structure and having filter coefficients relating to a long-time average of speech signals.

5. The multi-pulse excitation linear-predictive coder of claim 4, wherein the means for perceptually weighting the error signal has an impulse response which is zero after a duration at most equal to the spacing between two successive pulses in the grid.

6. The multi-pulse excitation linear predictive coder of claim 5, wherein the weighting filter has an autocorrelation function which is zero for delays equal to the spacing or to integral multiples of the spacing.

7. The multi-pulse excitation linear-predictive coder of claim 3, wherein the means for perceptually weighting the error signal has an impulse response which is zero after a duration at most equal to the spacing between two successive pulses in the grid.

* * * * *